United States Patent [19]

Cavagnaro

[11] 4,391,509

[45] Jul. 5, 1983

[54] ROLLER FUSER APPARATUS IN WHICH COPY SHEET JAMS ARE MINIMIZED

[75] Inventor: William A. Cavagnaro, Fairport, N.Y.

[73] Assignee: Eastman Kodak Company, Rochester, N.Y.

[21] Appl. No.: 362,438

[22] Filed: Mar. 26, 1982

[51] Int. Cl.[3] ..... G03G 15/20

[52] U.S. Cl. ..... 355/14 FU; 355/3 FU; 219/216; 432/60

[58] Field of Search ..... 355/14 R, 14 SH, 3 FU, 355/14 FU, 3 SH; 219/216; 432/60

[56] References Cited

U.S. PATENT DOCUMENTS

| | | | |
|---|---|---|---|
| 3,256,002 | 6/1966 | Hudson | 432/62 |
| 3,291,466 | 12/1966 | Aser et al. | 432/62 X |
| 3,324,791 | 6/1967 | Cassano et al. | 271/274 X |
| 3,452,181 | 6/1969 | Stryjewski | 219/388 X |
| 3,754,819 | 8/1973 | Braun | 355/3 FU |
| 3,794,417 | 2/1974 | Machmer | 355/14 FU |
| 3,810,776 | 5/1974 | Banks et al. | 219/388 |
| 3,878,540 | 4/1975 | Kawai | 355/14 R |
| 3,948,510 | 4/1976 | Iwamoto et al. | 355/14 R |
| 3,948,586 | 4/1976 | Komori et al. | 355/14 R |
| 4,162,847 | 7/1979 | Brandon | 355/14 FU |
| 4,272,666 | 6/1981 | Collin | 355/3 FU |
| 4,307,957 | 12/1981 | Kitagawa | 355/14 R |

*Primary Examiner*—R. L. Moses

*Attorney, Agent, or Firm*—William F. Noval

[57] ABSTRACT

A roller fuser including a driven roller and an idler roller which form a nip to fuse toner images to copy sheets. The idler roller is moved into and out of engagement with the driven roller by an expandable bladder which is inflated with a pressurized gaseous medium. A copy sheet detector is positioned very close to the nip exit of the rollers. In case of a copy sheet jam in the roller nip, the detector provides a jam detection signal which effects rapid exhaustion of gaseous medium from the bladder to disengage the rollers and prevent further driving of a copy sheet into the roller nip.

7 Claims, 6 Drawing Figures

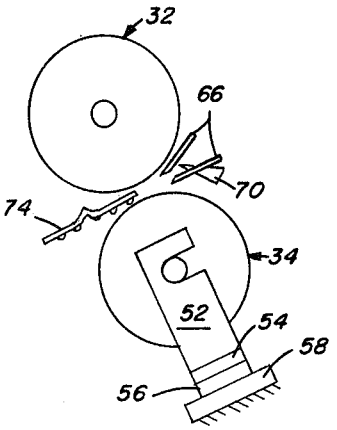
FIG. 3
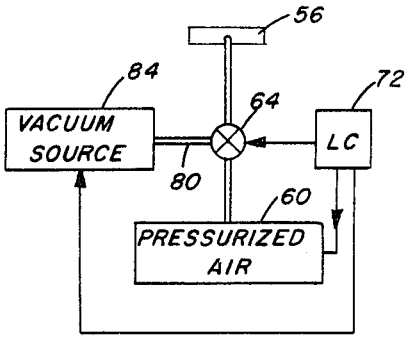
FIG. 5
FIG. 4
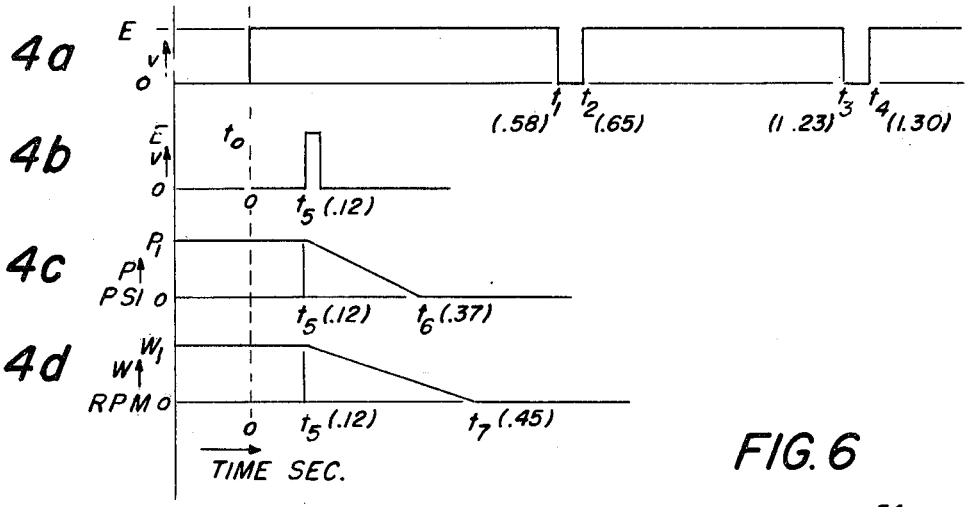
FIG. 6
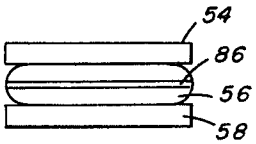

ROLLER FUSER APPARATUS IN WHICH COPY SHEET JAMS ARE MINIMIZED

BACKGROUND OF THE INVENTION

This invention relates in general to apparatus for fusing toner images to copy sheets in electrographic apparatus and more particularly this invention relates to roller fuser apparatus in which the severity of copy sheet jams are minimized by means of rapid detection of fuser jams and rapid deactuation of the fuser in response to such jam detection.

Electrographic copiers are commonly used to produce copies of original documents. The reproduced copies comprise toner images of the original which are permanently affixed to copy sheets by well known fusing techniques. One such technique consists of passing a copy sheet having toner images on one or both sides thereof through the nip of a pair of rollers, one or both of which are heated to permanently fuse the toner image(s) to the copy sheet through the application of heat and pressure. Roller fusers are complex and compact structures which include several interdependent elements to insure proper functioning of the roller fuser. Thus, in addition to the support structure for the fuser rollers and the rollers themselves, the following elements are usually incorporated into a fuser roller: (1) A heat source for heating one or both of the fuser rollers. Generally, either quartz lamps are inserted inside the fuser rollers or a heating element applies heat to the external surface of the fuser rollers. (2) Applicators for applying fuser release material such as silicone fuser oil to the surfaces of either or both fuser rollers in order to minimize or eliminate offset of toner from fused copy sheets to the rollers and to aid in releasing the copy sheet from the roller surfaces. (3) Sensors positioned close to the surface of either or both of the rollers to monitor the heat level of the fuser rollers in order to maintain the temperature within predetermined limits and also to signal overheating so that the fuser roller may be shut down. (4) An enclosure in order to confine the heat from the fuser within the environs thereof to maintain efficient heating and to prevent heat from passing into the environment of the electrophotographic copier to degrade other components within the copier. (5) Copy sheet transport devices both in the inlet and outlet of the nip of the fuser roller; and (6) Skive elements at the roller nip exit to assist in stripping copy sheets from the fuser rollers. Since a high temperature resistant elastomeric material such as silicone rubber is commonly used as a fusing layer, it is advisable to provide a mechanism for engaging and disengaging the fuser rollers when not in use in order to prevent undesirable permanent set of the elastomeric material during nonuse of the copier.

Although roller fusers used in commercial electrographic copiers are so designed that copy sheets are routinely passed through the nip of the fuser roller, due to the dynamics of high-speed copiers and the tendency of heated copy sheets to adhere to fuser rollers during the fusing operation, jamming of copy sheets in the roller fuser does occur. Copy sheet jams are undesirable for a number of reasons. First, a copy sheet jam normally triggers a shutdown of the copier in order to prevent permanent damage to components of the copier. Second, in high-speed copiers, the response time to stop feeding copy sheets into the fuser is usually not short enough to prevent the feeding of two or three copy sheets into the roller fuser before shut down of copier operations. Due to the crowded nature of the elements of the fuser mechanism, the jamming together of two or three copy sheets into such a mechanism makes it difficult for an operator to clear jams easily and safely so that normal copier operation can be resumed. Moreover, during multiple sheet jams exit skives may be bent and driven into the fuser rollers, thus necessitating replacement of the skives and fuser rollers.

Since the trend in copier duplicators is to higher and higher copy output and to the production of duplex as well as simplex copies, roller fusers have become more complex and compact, thus exacerbating the difficulties caused by fuser jams. It is thus desirable to provide a roller fuser in electrographic copiers which may be deactuated rapidly in case of a jam so that at most only one copy sheet is jammed in the fuser. It is also desirable that provision be made for the easy and safe removal of a jammed copy sheet from the roller fuser and that any jammed copy sheet not cause permanent damage to the elements of the fuser. Limitation of copy sheet jams to a single sheet also permits faster recovery of copier operation.

SUMMARY OF THE INVENTION

According to the present invention, there is provided apparatus for minimizing the jamming of copy sheets in a roller fuser used to fuse toner images to either or both sides of a copy sheet produced in an electrographic copier. According to an aspect of the invention, the roller fuser includes a first driven roller and a second idler roller. The second roller is mounted for movement into and out of engagement with the first roller with which it forms a fusing nip by means of an expandable bladder which is inflatable by a pressurized gaseous medium. Inflation of the bladder causes engagement of the second roller with the first roller thus causing the driven first roller to rotate the second roller. A copy sheet detector is positioned very close to the exit nip of the rollers and in the case of a copy sheet jam in the roller nip provides a jam detection signal which effects rapid exhaustion of gaseous medium from the bladder to disengage the fuser rollers and prevent further driving of a copy sheet into the fuser roller nip.

The invention and its features and advantages will be set forth and become more apparent in the detailed description of the preferred embodiment presented below.

BRIEF DESCRIPTION OF THE DRAWINGS

In the detailed description of the preferred embodiment of the invention presented below, reference is made to the accompanying drawings, like numbers indicating like elements in which

FIG. 3 is a diagrammatic elevational view of the roller fuser of FIG. 2 in which the fuser rollers are shown disengaged;

FIGS. 4(*a*), (*b*), (*c*) and (*d*) are timing diagrams illustrating the operation of the roller fuser of the present invention;

FIG. 5 is a modification of the roller fuser control system of FIG. 2; and

FIG. 6 is a modification of the bladder shown in FIG. 2.

DESCRIPTION OF THE PREFERRED EMBODIMENTS

Figure 1:
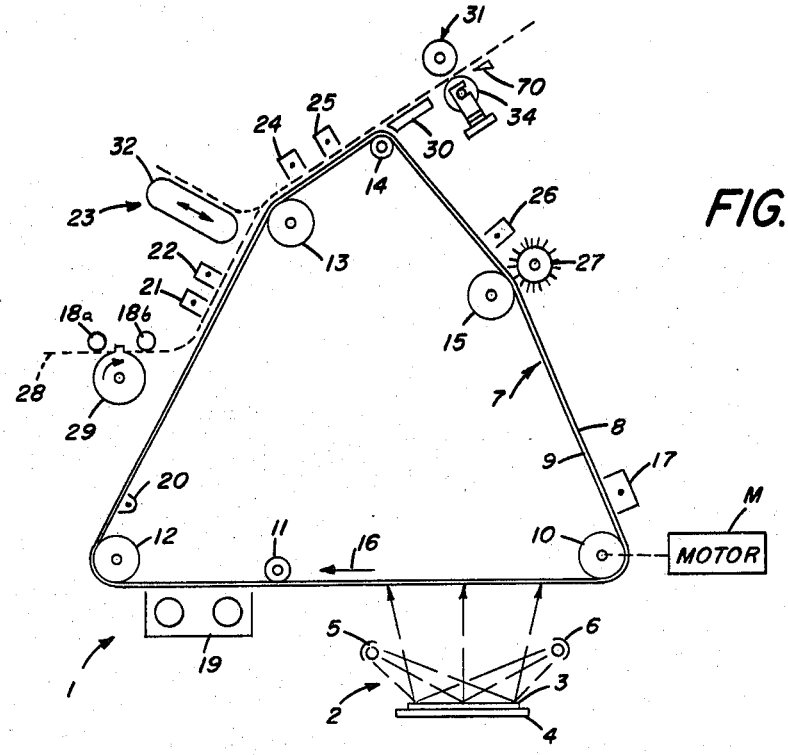
FIG. 1 is a schematic diagram of electrographic apparatus including a roller fuser according to the present invention.

Referring now to FIG. 1, there is shown electrographic apparatus including a roller fuser according to the present invention. The electrographic apparatus of FIG. 1 comprises an electrophotographic copier which is capable of producing simplex or duplex images on a copy sheet processed by the copier. The electrophotographic copier shown is more completely described in commonly assigned U.S. Pat. Nos. 4,095,979 and 4,174,905 the enclosures of which are incorporated herein by reference.

As shown in FIG. 1, electrophotographic copier 1 includes an exposure station 2 at which documents are positioned to be copied. Documents may be fed to station 2 manually or automatically by means of a recirculating document feeder such as that disclosed in U.S. Pat. No. Re. 27,976. As disclosed, a plurality of sheets of a document having images on first sides of the sheet are repeatedly fed in succession from a stack of documents to exposure platen 2 of copier 1. A document 3 positioned on platen 4 of copier 1 is illuminated by flash lamps 5 and 6 to produce a light image of the document which is projected onto a discrete image area or frame of a photoconductive web 7. Web 7 defines a plurality of successive frames which are processed at different stations spaced about web 7.

Photoconductive web 7 has a photoconductive layer 8 on a conductive layer (not shown) and a transparent support layer 9. Web 7 is trained about rollers 10, 11, 12, 13, 14, and 15. Motor M is coupled to roller 10 in a conventional manner and drives web 7 in a clockwise direction indicated by arrow 16. Movement of web 7 causes successive frames thereof to sequentially pass a series of electrophotographic work stations.

For the purpose of the instant description, the several work stations along the path of movement of web 7 may be described as follows:

A charging station including corona charger 17 at which photoconductive layer 8 of web 7 is sensitized by receiving a uniform electrostatic charge of a first polarity;

An exposure station 2 at which the inverse image of an original document is projected onto photoconductive layer 8 of web 7 to form a latent electrostatic image corresponding to the original image through the dissipation of the electrostatic charge at exposed areas of photoconductive layer 8;

A development station including magnetic brush developer 19 at which developing powder including charged toner particles of a polarity opposite to the charge of the latent image on web 7 are brushed over photoconductive layer 8 to cause toner to adhere to the electrostatic image thereby rendering the image visible in the form of a transferable unfixed toner image;

A post-development erase station including illumination source 20 at which web 7 is illuminated to reduce photoconductor fatigue and to facilitate subsequent toner image transfer;

A first transfer station including first transfer charger 21 at which a first toner image is transferred to the first side of a copy sheet brought into contact with web 7 and a first detack charger 22 which neutralizes the charge on the copy sheet so that it may be easily separated from web 7;

A copy sheet turnover mechanism 23 for turning over the copy sheet while a first toner image is unfixed;

A second transfer station including second transfer charger 24 which transfers a second toner image to the second side of a copy sheet and a second detack charger 25 which neutralizes the charge on the copy sheet so that it may be separated from web 7 at roller 14; and A cleaning station including corona charger 26 and brush 27 which respectively remove residual elctrostatic charges and toner particles remaining on web 7.

Copier 1 also includes a copy sheet path 28 along which copy sheets are moved seriatim such as by rollers 18*a* and 18*b* to receive toner images from photoconductive web 7. A supply of copy sheets (not shown) is provided from which individual sheets are moved along path 28 to registration mechanism 29 which registers and aligns copy sheets with toner images formed on web 7. If simplex copies are made, successive sheets are sequentially registered by mechanism 29 with successive toner images respectively formed on web 7 at transfer station 21 and are transported on web 7 until they are separated from web 7 at roller 14. The simplex copies are then fed into the nip of roller fuser 31 which fixes the unfixed simplex toner images to the copy sheets. Thereafter, the fixed sheets are transported to an output tray or to a copy handling accessory such as a finisher as is disclosed more fully in the abovementioned U.S. Pat. Nos. 4,095,979 and 4,174,905.

If duplex copies are made, first and second sequential toner images are formed on web 7 by means of the above-mentioned electrophotographic process. A copy sheet registered and aligned by mechanism 29 with the first toner image on web 7 receives such image at first transfer station 21. After neutralization of the charge between the copy sheet and web 7 by first detack charger 22, vacuum belt 32 of turn-over mechanism 23 separates the copy sheet from web 7, turns it over while the first toner image is unfixed and refeeds it into contact with the second toner image on web 7 in advance of second transfer charger 24. The second image is then transferred to the other side of the copy sheet and after neutralization of the charge between the sheet and web 7 by charger 25, it is fed to roller fuser 31 which fuses both images to the copy sheet.

Figure 2:
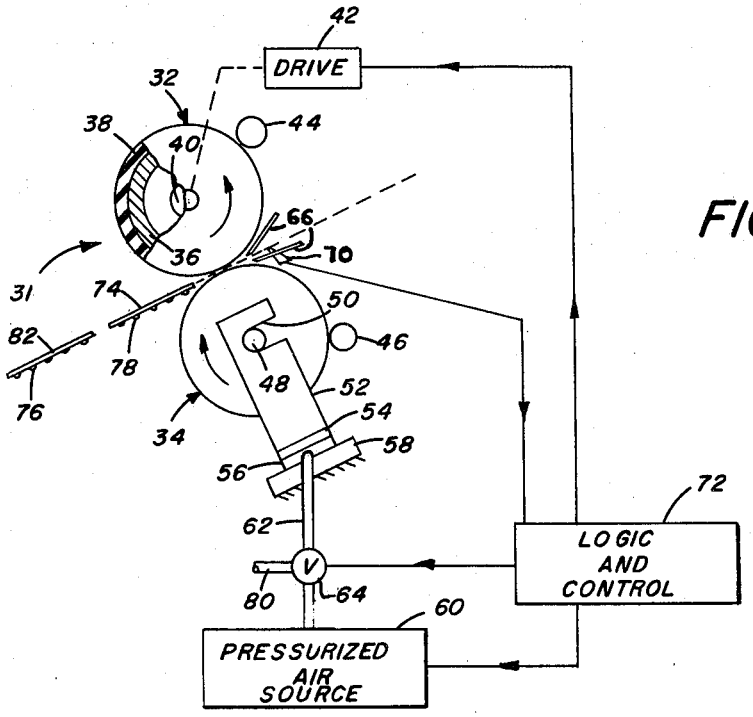
FIG. 2 is a diagrammatic elevational view of the roller fuser of FIG. 1 shown in more detail but with the fuser rollers shown in engagement and including a schematic diagram of a control system according to the present invention.

Referring now to FIGS. 2 and 3, there is shown in greater detail, a preferred embodiment of roller fuser according to the present invention. As shown, roller fuser 31 includes a pair of fuser rollers 32 and 34 which form a nip for permanently fusing through the application of heat and pressure toner images carried by copy sheets passed through the nip. As shown in the broken-away section of roller 32, it comprises an inner cylindrical member 36, of heat-conductive material such as aluminum which efficiently conducts heat from a heat source such as quartz lamp 40 through to fuser elastomeric layer 38. Layer 38 is of suitable high temperature resistant elastomeric material which resists pickup of toner and other debris from a fused copy sheet. Suitable elastomeric materials include silicone elastomer, fluorosilicone elastomer, and the fluoroelastomer comprising a copolymer of vinylidene fluoride and hexafluoropropylene.

Roller 34 is of similar construction and together with roller 32 define a nip through which a copy sheet carrying toner images on either or both sides is passed in order to permanently fuse the image to the copy sheet.

Roller 32 is rotatably mounted on the mainframe of the copier by suitable means (not shown) and is rotated in a counterclockwise direction by a suitable drive 42 connected to roller 32. Since there is some chance of pickup of contaminants on the fusing surfaces of rollers 32 and 34, they are coated with a layer of a liquid release material such as silicone fuser oil by applicator rollers 44 and 46 which are supplied from a suitable oil supply (not shown).

Roller 34 is mounted for movement into and out of pressure engagement with driven roller 32. When roller 34 is in engagement with roller 32, it is driven in a clockwise direction by roller 32 and when roller 34 is out of engagement with roller 32 it idles.

Roller 34 is mounted by means of gudgeons 48 in U-shaped slots 50 in upright support members 52 (only one of which is shown). Upright member 52 is integral with cross member 54 which extends the length of fuser roller 34. In contact with the bottom of member 54 is an expandable bladder 56 of resilient material which is supported by member 58 mounted to the frame of copier 1. Bladder 56 is supplied with pressurized gaseous medium such as air from source 60 by means of conduit 62. Inserted into conduit 62 is a two-way valve 64 of known construction which has a first position in which source 60 is connected to bladder 56 to supply air under pressure thereto to expand it. In a second position to be described in somewhat greater detail hereinafter, air from bladder 56 is ported to the atmosphere through conduit 82 to quickly exhaust air from bladder 56. A vacuum source (FIG. 5) may also be connected to valve 64 in order to more quickly exhaust air from bladder 56 when a jam is detected.

Positioned at the exit of the nip formed by rollers 32 and 34 are skives 66 which are close to but not touching the surfaces of rollers 32 and 34. Skives 66 assist in separating any copy sheets which have a tendency to stick to the surface of rollers 32 and 34. Located beyond skives 66 is a vacuum belt 68 which transports a fused copy sheet out of copier 1 and cools the copy sheet while maintaining it in a flat condition to prevent the sheet from curling.

Located just beyond the exit of the nip formed by rollers 32 and 34 is copy sheet detector 70 which may be any well known type of mechanical, pneumatic or photo-optical detector.

Logic and control 72 is provided to control the operation of copier 1 and to monitor the passage of a copy sheet along path 28 to detect any copy sheet jams such as may be caused in fuser 31 by copy sheets sticking to one of the rollers 32 and 34. A suitable logic and control which may be used in the present apparatus is shown and described in the aforementioned commonly assigned U.S. Pat. Nos. 4,095,979 and 4,174,905 which describe the control of apparatus for producing simplex and duplex copies. Where fuser 31 is used in a simplex copier, a suitable control is shown and described in commonly assigned U.S. Pat. No. 3,914,047.

Upon the initiation of copier operation, logic and control 72 starts drive 42 and also Motor M so that the various mechanisms in copier 1 cause web 7 to be moved by roller 10 in the direction of arrow 16. Sequential operation of the various work stations around web 7 to produce transferable toner images on the photoconductive layer 8 of web 7. At the appropriate time, copy sheets are fed seriatim along path 28 into transfer relationship with web 7 to receive toner images on one or both sides of the copy sheet. Logic and control 72 has actuated valve 64 to feed pressurized air to bladder 56 over conduit 62 so that roller 34 is brought into engagement with roller 32. Since drive 42 is rotating roller 32 in a counterclockwise direction, roller 34 is driven by roller 32 to form a nip through which a copy sheet carrying a toner image will be driven by rollers 32, 34. Logic and control 72 will also have actuated quartz lamps 40 to bring the surfaces of rollers 32 and 34 up to fusing temperatures which may, for example, be in the range of 150° C. to 200° C.

Under normal conditions of operation, a copy sheet such as 74 and 82 (FIG. 2) respectively carrying toner images 76 and 78 on the lower sides thereof is fed into the nip of rotating rollers 32 and 34 to have the images 76 and 78 permanently fixed thereto by the application of heat and pressure by rollers 32, 34. As sheet 74 exits from the nip of rollers 32, 34 detector 70 detects the leading edge thereof at a predetermined time and sends a signal to logic and control 72 to indicate that a jam has not occurred in roller fuser 30. Thereafter, vacuum belt 68 carries the fused copy sheet to an appropriate output tray or the like.

If, however, detector 70 does not detect the presence of a copy sheet at a predetermined time, such absence of a copy sheet indicates that the sheet may have been trapped in the roller fuser environment and that a jam has occurred somewhere in the system. In order to avoid false indication of a jam if a copy sheet feed is late or slow, the signal to logic and control 72 is preferably delayed a predetermined period of time. If, after this delay, detector 70 still signals an absence of a copy sheet, then a jam signal is sent to logic and control 72 which actuates valve 64 to rapidly exhaust air from bladder 56 to the atmosphere by means of short conduit 80. Collapse of bladder 56 disengages roller 34 from roller 32 and effectively stop rotation of roller 34 and consequent driving of copy sheet 74 through rollers 32 and 34. Due to its momentum, roller 34 may continue to coast a short time and copy sheet 74 may continue to be driven a small distance. However, in the worst case, only one copy sheet will be jammed in roller fuser 30 so that multiple copy sheets will not be crushed into the fuser roller to damage skives 66 and consequently the surfaces of fuser rollers 32, 34.

Ordinarily if a jam does occur in roller fuser 30, copy sheet 74 will not have been driven all the way through the nip of rollers 32 and 34. Thus, after roller 34 has been disengaged from roller 32, copy sheet 74 may be removed by an operator from the input to the fuser nip thus facilitating removal of the copy sheet. FIG. 3 shows the disengagement of roller 34 from roller 32 and the crumpling up of a copy sheet 74 in the nip between rollers 32 and 34.

Referring now to FIG. 4, there are shown timing diagrams for the roller fuser apparatus according to the present invention shown in FIG. 2. If it is assumed that copier 1 is processing copy sheets which are either $8\frac{1}{2}'' \times 11''$ or $8\frac{1}{2}'' \times 14''$, then the longitudinal dimension of an image area of web 7 constituting a frame should be equal to the maximum width of a copy sheet processed plus an interframe distance between the usable imaging area and the next image area. Thus for an $8\frac{1}{2}$-inch effective image area on web 7 and a 1-inch interframe distance, the longitudinal dimension of a frame on belt 7, may for example, equal 9.5 inches. If six frames are disposed about the length of web 7 the total length thereof would be 57 inches. If the rate of speed of web 7 is approximately 14½ inches per second which is also the rate of speed of a copy sheet transported along path 28, then there is an interval of 0.65 seconds between successive interceptions of the lead edges of successive copy sheets by detector 70 in the simplex mode. If copier 1 is operating in the simplex mode 8½-inch wide copy sheets are fed with a 1-inch separation between adjacent copy sheets. Where duplex copies are produced by copier 1, the leading edges of adjacent copy sheets are spaced two frames apart since two toner images will have been transferred to one copy sheet. In the roller fuser shown in FIG. 2, simplex copies are being produced by copier 1 and copy sheets 74 and 82 would be spaced on inch apart given the above parameters and have simplex images on the lower faces thereof.

In the timing diagram of FIG. 4(*a*) detector 70 is shown to be actuated at time $t_o$ when the leading edge of copy sheet 74 is detected by detector 70. Assuming that fuser roller 31 is operating normally, detector 70 is turned on to produce a signal that goes from a zero voltage to a voltage E. Detector 70 is maintained on until the trailing edge of copy sheet 74 turns it off at a time $t_1$ (e.g., 0.58 sec.) after actuation of detector 70. Detector 70 is then turned off during the interframe distance between successive copy sheets until copy sheet 82 turns detector 70 on at time $t_2$ (e.g., 0.65 sec.). Detector 70 then remains on until the trailing edge of sheet 82 turns it off at a time $t_3$ (e.g., 1.23 sec.) and a next succeeding copy (not shown) turns detector 70 on again at a time $t_4$ (e.g., 1.30 sec.).

FIG. 4(*b*) shows a timing diagram where a copy sheet has not been detected by detector 70 at the expected time $t_0$. Logic and control 72 is programmed to wait a delay period $t_5$ from time $t_0$, and if a copy sheet is not detected by time $t_5$ (e.g., 0.12 sec.), then a control signal is generated by logic and control 72 as an indication of a copy sheet jam in roller fuser 31. This signal actuates two-way valve 64 to shut off the supply of pressurized air from source 60 to bladder 56 and to open conduit 62 to the environment at exhaust conduit 80.

Pressurized air is swiftly exhausted from bladder 56 due to the pressure exerted thereon by the weight of roller 34 and its mounting. This is illustrated by FIG. 4(*c*) in which during a period from $t_5$ to $t_6$ (e.g., 0.25 sec.), the pressure in bladder 56 has dropped to zero from the fully engaged pressure $P_1$. As roller 34 disengages from roller 32, it ceases to be driven thereby and comes to a rest at some time after complete exhaustion of air from bladder 54 due to coasting caused by roller momentum. This is shown in FIG. 4(*d*) where the rotational velocity of roller 32 is shown to drop from $\omega_1$ to 0 at a time $t_7$ (e.g. 0.45 sec.) after detection of a jam by sensor 70. Sensor 70 is positioned as close as practicable to the nip of rollers 32 and 34, preferably substantially less than the width of a copy sheet (e.g., 2 inches which is approximately ¼ the width of an 8½ wide copy sheet). Therefore, a copy sheet which has been jammed in roller fuser 30 is driven a substantial distance through the roller nip but generally does not pass completely through the nip. Thus, the copy sheet may be cleared from the left side of roller fuser 30 which is less crowded with fuser elements such as skives 66, transport 68, and fuser oil applicators 44 and 46. In addition, copy sheets (such as sheet 82—FIG. 2) which follow on closely to copy sheet 74 are not driven into the fuser roller to cause a multiple sheet jam therein.

In the case of duplex copies, the sheet-to-sheet spacing is less critical than in simplex copies since the distance between adjacent copy sheets is greater than an image frame. This spacing is due to the fact that two images are transferred to a single copy sheet and the number of copy sheets produced in duplex operation is approximately one-half the number of copy sheets processed in simplex operation.

FIG. 5 illustrates a modification of the fuser roller of FIG. 2 according to the present invention. As shown, a vacuum source 84 is connected to the exhaust conduit 80 from valve 64 to accelerate the exhaustion of pressurized air from bladder 56. After logic and control 72 has actuated valve 64 to cut off the supply of air from source 60 to bladder 56, control 72 sends a signal to vacuum source 84 to rapidly exhaust air from bladder 56. Thus the response time is improved and the likelihood of a copy sheet completely passing through the nip of rollers 32 and 34 is lessened so that removal of the jammed sheet from the input to the roller nip is facilitated.

In order to minimize the quantity of air required to deflate bladder 56, as shown in FIG. 6, a filler plate 86 may be disposed inside bladder 56 to decrease the volume thereof and thus cut down on the time required to disengage roller 34 from roller 32.

Thus, there is seen according to the present invention that roller fuser apparatus is provided in which the severity of copy sheet jams is minimized. Once a jam is detected, the drive of a copy sheet through the fuser roller nip is deactivated rapidly so that only a single sheet is jammed in the roller fuser. The invention facilitates removal of a jammed copy sheet from the fuser rollers and eliminates permanent damage to elements of the roller fuser caused by multiple sheet jams. Moreover, the quick response time of the roller fuser according to the present invention prevents the buildup of more than one copy sheet in the roller fuser when a jam occurs.

The invention has been described in detail with particular reference to preferred embodiments thereof. However, it will be understood that variations and modifications can be effected within the spirit and scope of the invention.

What is claimed is:

1. In electrophotographic apparatus including a path along which copy sheets with toner images are moved in spaced relationship with each other, roller fuser apparatus comprising:

first and second rotatable rollers forming a nip for fusing toner images to copy sheets pased through the nip;

means for rotating said first roller;

expandable bladder means for moving said second roller between a first position out of engagement with said first roller and a second position in engagement with said first roller, wherein in said second position (1) said second roller is rotated by said first roller, and (2) said first and second rollers form a nip for fusing copy sheets with toner images as they are driven through said nip by rotation of said rollers;

valve means (1) for connecting said bladder means to a source of pressurized gaseous medium to expand said bladder means to move said second roller between said first and second positions and (2) for disconnecting said bladder means from said source of pressurized gaseous medium to deflate said bladder means through exhaustion of gaseous medium therefrom, thereby to move said second roller between said second and first positions;

said bladder means including a filler element to minimize the amount of gaseous medium to be exhausted to deflate said bladder means; and means located adjacent to the exit of the nip formed by said rollers for detecting a jam of a copy sheet in said roller nip and for producing a signal when a copy sheet jam is detected to actuate said valve means to disconnect said bladder means from said source thereby deflating said bladder means and moving said second roller between said second and first positions, such that rotation of said second roller is halted to prevent further driving of the jammed copy sheet through said nip so as to permit removal of said copy sheet from the input to said nip and to prevent driving of subsequent copy sheets into said nip while said jam exists.

2. The apparatus of claim 1 wherein said means for detecting detects the presence or absence of a copy sheet at periodic predetermined times and a jam signal is produced when a copy sheet is not detected at the predetermined time.

3. The apparatus of claim 2 wherein said jam signal production is delayed for a preselected interval after said predetermined time to avoid a false indication of a jam.

4. The apparatus of claim 1 wherein said means for detecting is located less than ½ the width of a copy sheet from the nip of said first and second rollers.

5. The apparatus of claim 1 wherein said means for detecting is located approximately ¼ the width of a copy sheet from the nip of said first and second rollers.

6. Apparatus for fusing unfused toner images on copy sheets, comprising:

first and second rotatable fuser rollers;

drive means for rotating one of said rollers;

expandable bladder means for moving said second roller between (i) a first position out of engagement with said first roller, and (ii) a second position in engagement with said first roller to form a sheet engaging nip for fusing toner images on copy sheets advanced through said nip;

means for applying pressurized fluid to said bladder means to expand said bladder means and move said second roller from said first position to said second position;

means adjacent to said nip for detecting a copy sheet jam in said nip and for producing a signal when such jam is detected; and means responsive to said signal for deflating said bladder means so as to move said second roller from said second position to said first position to prevent further driving of a jammed copy sheet in said nip, said bladder means including a filler element to minimize the amount of fluid to be removed in deflating said bladder means.

7. Apparatus for fusing unfused toner images on copy sheets, comprising:

first and second rotatable fuser rollers;

drive means for rotating one of said rollers;

expandable bladder means for moving said second roller between (i) a first position out of engagement with said first roller, and (ii) a second position in engagement with said first roller to form a sheet engaging nip for fusing toner images on copy sheets advanced through said nip;

means for applying pressurized fluid to said bladder means to expand said bladder means and move said second roller from said first position to said second position;

means adjacent to said nip for detecting a copy sheet jam in said nip and for producing a signal when such jam is detected; and means responsive to said signal for deflating said bladder means so as to move said second roller from said second position to said first position to prevent further driving of a jammed copy sheet in said nip, said deflating means including a vacuum source for accelerating the deflation of said bladder means.

* * * * *